United States Patent [19]

Touzani

[11] Patent Number: 4,773,458

[45] Date of Patent: Sep. 27, 1988

[54] COLLAPSIBLE HOLLOW ARTICLES WITH IMPROVED LATCHING AND DISPENSING CONFIGURATIONS

[76] Inventor: William Touzani, 3192 Morning Way, La Jolla, Calif. 92037

[21] Appl. No.: 916,528

[22] Filed: Oct. 8, 1986

[51] Int. Cl.[4] ..... B65D 1/40; B65D 1/44; F16L 11/00; F16L 11/11

[52] U.S. Cl. ..... 150/55; 215/1 C; 220/8; 138/121; 222/107; 222/215

[58] Field of Search ..... 150/55; 222/107, 215; 138/121, 122; 220/8; 215/1 C, 11 C; 285/226, 227

[56] References Cited

U.S. PATENT DOCUMENTS

| | | | |
|---|---|---|---|
| 3,340,869 | 9/1967 | Bane | 222/215 X |
| 3,390,821 | 7/1968 | Mullan | 222/215 X |
| 3,409,224 | 11/1968 | Harp et al. | 138/121 X |
| 3,559,692 | 2/1971 | Mantelet | 138/121 |
| 3,908,704 | 9/1975 | Clement et al. | 138/121 |
| 3,929,165 | 12/1975 | Diebolt et al. | 138/121 |
| 3,939,887 | 2/1976 | Scarnato | 150/55 |
| 4,044,836 | 8/1977 | Martin et al. | 222/215 X |
| 4,377,191 | 3/1983 | Yamaguchi | 150/55 |
| 4,492,313 | 1/1985 | Touzani | 150/55 X |
| 4,526,296 | 7/1985 | Berger et al. | 222/107 |

FOREIGN PATENT DOCUMENTS

| | | | |
|---|---|---|---|
| 688612 | 6/1964 | Canada | 150/55 |
| 1296900 | 6/1969 | Fed. Rep. of Germany | 138/121 |
| 2042593 | 3/1972 | Fed. Rep. of Germany | 150/55 |
| 2109247 | 6/1983 | United Kingdom | 215/11 C |
| 2138525 | 10/1984 | United Kingdom | 285/226 |

*Primary Examiner*—William Price
*Assistant Examiner*—Sue A. Weaver
*Attorney, Agent, or Firm*—James M. Deimen

[57] ABSTRACT

Hollow articles such as plastic bottles and tubes having a portion of the sidewall including latching bellows, are formed with modified inner and outer fold rings to reduce the angular flexure between unfolded and folded (latched) bellow walls. The bellow walls are modified by reducing the slope of the walls as they approach the inner fold rings to thereby reduce the unfolded (unflexed) angle between the walls at the inner fold rings. The modified geometry permits better utilization of high density linear polymer plastics by lessening or preventing the "crystalline" fracturing and lamination at the inner fold ring with the first latching of the bellows. The bottle material is therefore no longer weakened at the inner fold ring. The modified geometry also permits use of low density polymer plastics and rubber for latching bellows with thicknesses and geometries that otherwise would tend to eventually spring back rather than latch. Also disclosed are dispensers incorporating combinations of latching and non-latching bellows with a raised base.

26 Claims, 2 Drawing Sheets

COLLAPSIBLE HOLLOW ARTICLES WITH IMPROVED LATCHING AND DISPENSING CONFIGURATIONS

BACKGROUND OF THE INVENTION

The field of the invention pertains to hollow articles such as containers and tubular products of flexible plastic construction and, in particular, to such articles formed with a plurality of sidewall bellows to permit collapse of the container or tubular product. An example of such a container product is disclosed in applicant's U.S. Pat. No. 4,492,313 reissued as U.S. Pat. No. Re 32,379. A number of other examples of collapsible containers are disclosed in the numerous references cited in applicant's reissue patent above.

Bottles manufactured according to applicant's above patent have proven to be successful for a number of plastic materials, however, the folding action causes some plastic materials to crack or craze at the inner fold rings producing grey or cloudy rings in otherwise clear bottles. The cracking or crazing is caused by severe angular deformation of the plastic material at the inner fold rings. While not detracting from the visual appearance of the bottles, the cracking and crazing weakens some bottles although permitting the bottles to fold and latch more easily.

More particularly, as an example, high density polyethylene bottles possess improved latching subsequent to the first or initial collapse after manufacture and the strength of the bottle is not seriously impaired. Polyvinyl chloride bottles, however, are weakened at the inner fold rings after the initial collapse that splits the plastic material. Reusing these bottles therefore would be inadvisable.

Bottles blown from elastomeric materials, polyethylene terepthalate and low density plastics generally do not laminate or craze at the inner fold rings with the initial collapse of the bottle. The bottles retain their strength but, as a result, the latching effect is impaired and the collapse of the bottles is not as effective as with the high density plastics.

With a view toward making the latching effect for collapsible bottles and other hollow articles more effective for a greater variety of plastic materials, applicant has developed the improvements disclosed below.

SUMMARY OF THE INVENTION

Further improvements to the latching bellows of hollow articles such as plastic bottles and tubes include a portion of the bellows sidewall formed with modified inner fold rings. The bellow walls are modified by reducing the slope of the walls as they approach the inner fold rings to thereby reduce the unfolded (unflexed) angle between the walls at the inner fold rings. The slopes of the walls of the bellows are otherwise unchanged with the exception of the areas immediately adjacent the inner fold rings. The change in volume or change in length of the hollow article remains substantially the same with the modified inner fold rings.

The modified geometry permits better utilization of high density linear polymer plastics by lessening or preventing the "crystalline" fracturing at the inner fold rings with the first latching of the bellows. The bottle material is not weakened at the inner fold rings by fracturing because the plastic material is not deformed beyond the elastic limit. Nevertheless, the folding and latching of the bellows remains unimpaired. With the modified inner fold rings high density linear polyethylene and polyvinyl chloride plastics can be more widely exploited for folding bottles and other hollow articles.

The modified geometry also permits use of low density polymer plastics, elastomers and rubber materials that otherwise would fail to positively latch and therefore spring back to uncollapsed condition. Surprisingly, the modified geometry to improve the latching effect of the bellows by reducing the deformation of relatively rigid plastics above, also improves the latching effect of relatively soft and elastic materials by reducing the deformation at the inner fold rings. In both cases the inner fold ring is formed or molded with a very large angle (approaching 360°) on the inside of the bottle or hollow article. Only a few degrees or less are available for deformation during folding with the balance of the necessary deformation distributed in the bellow walls approaching the inner fold rings.

As an example of a hollow article utilizing the modified latching bellows in combination with non-latching bellows a dispensing bottle is disclosed. Although the dispensing bottle is disclosed with the modified latching bellows of this application, the latching bellows of applicant's above noted patent may be utilized. Thus, a wide variety of bottle materials are available and suitable for such a dispensing bottle.

DESCRIPTIONS OF THE PREFERRED EMBODIMENTS.

Figure 1A:
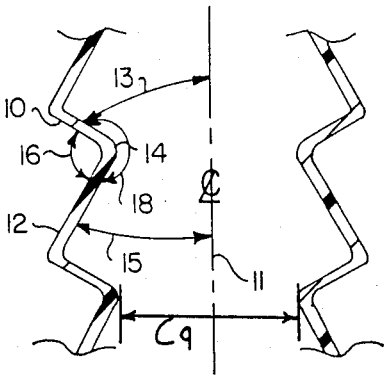
FIGS. 1*a* and 1*b* are schematic partial sections of an unmodified latching bellows at the inner fold ring.
Figure 1B:
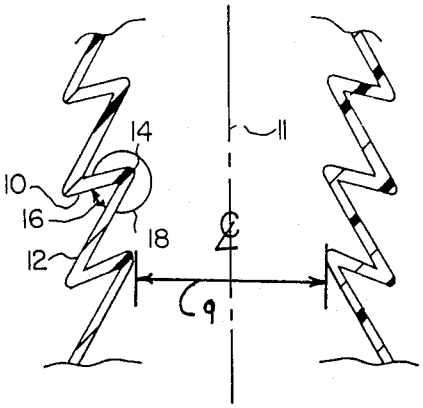

Illustrated in FIGS. 1*a* and 1*b* are the unfolded and folded angular relations between two bellow sidewalls 10 and 12 at the inner fold ring 14. The acute angle 16 which may be typically about 90° is toward the outside and the supplementary angle 18 of about 270° is toward the inside or axis 11 of a substantially cylindrical hollow article. Upon latching collapse the acute angle 16 may be typically 5° with the supplementary angle 18 increasing to 355°. The 85° change in angle at the inner fold ring causes a substantial deformation of the plastic material at the inner fold ring without substantially reducing the inner fold ring diameter 9. The angles are shown expanded at the interests of clarity. With certain materials crystallization or lamination and microscopic splitting occur at the inner fold ring 14 assisting to make the bellows latch more securely and to remain latched.

A freshly made hollow article before the first collapse requires substantially more effort to collapse because the inner fold rings are undamaged by crystallization, cracking and crazing and therefore do not act effectively as hinges. With the initial collapse and substantial deformation of the inner fold ring, the fold ring becomes a hinge that no longer requires the relatively high effort to deform. As a result the bellows deform and latch more easily and securely. The small radius at the inner fold ring of a freshly made hollow article is believed to sharpen with the first collapse. The above effect can best be utilized only for plastic resins that crystallize such as some grades of high density polypropylene and polyvinyl chloride. However, for some grades of polyvinyl chloride the crystallization and cracking impairs the usefulness of the hollow article by weakening the side wall at the inner fold rings more than is acceptable especially if multiple flexings of the bottles are required as in the case of extending a bottle for filling after the bottle has been stored and transported collapsed.

Relatively more elastic plastic materials and, in particular, plastics which do not crystallize and crack with the deformation of the bellows inner fold rings, do not latch as effectively because the inner fold rings are not weakened to form hinges. Repeated collapses require substantially the same effort. The inherent memory of the resin remains and resists the latched state of the bottle. The only approved resin for carbonated beverages, polyethylene terepthalate, does not crystallize and would not likely form the necessary hinged inner fold rings for best latching action.

Figure 2A:
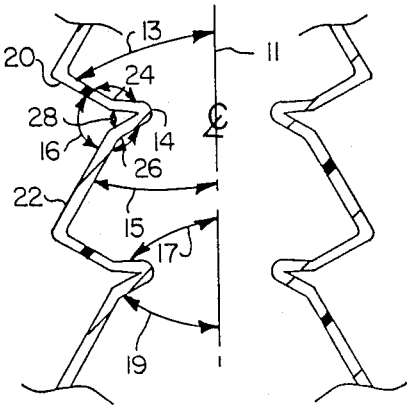
FIGS. 2*a* and 2*b* are schematic partial sections of a modified bellows at the inner fold ring.
Figure 2B:
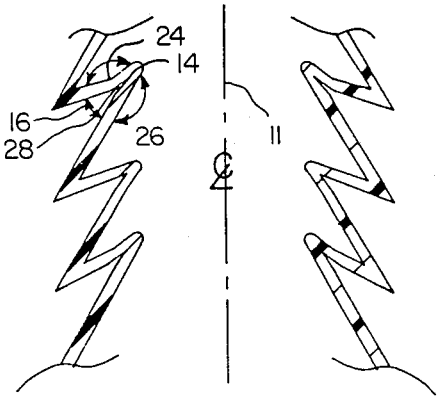

In FIGS. 2*a* and 2*b* the modified angular relationships of the two bellow sidewalls are illustrated in the unfolded and in the folded or latched position. In the unfolded position the side walls 20 and 22, may retain the same angular relationship as above which is about 90° and the same angular relationships 13 and 15 to the centerline 11. Adjacent the inner fold ring area the side walls 20 and 22 change in angular relationship at 24 and 26 respectively as shown by the angles of about 140° in each sidewall. The transition need not be a sharp change but may be a smooth transition curvature. As a result the as molded and unfolded angle 28 between the sidewalls at the inner fold rings is about 10° (exaggerated for clarity).

With folding to the latched position as shown in FIG. 2*b*, the angle 28 decreases to about 5° and the angles at 24 and 26 increase to about 160°. The angular relationships of the sidewalls at the inner fold ring 14 to the centerline 11 are increased as shown at 17 and 19. The deformation at the inner fold rings, however, is greatly decreased. In the unmodified inner fold ring illustration of FIG. 1 the angular decrease is from 90° to 5° or to about one eighteenth. In the modified inner fold ring illustration of FIG. 2, the angular decrease is from 10° to 5° or to about one half. At angles 24 and 26 the increase of 20° is a very small deformation spread over a relatively large area of side wall. The modified inner fold ring of FIG. 2 and FIG. 3 below tends to be thinner in wall thickness because of the mold configuration as the parison is blown against the bottle mold in making the bottle. The thinning replaces the hinging action of the unmodified inner fold ring.

Figure 3A:
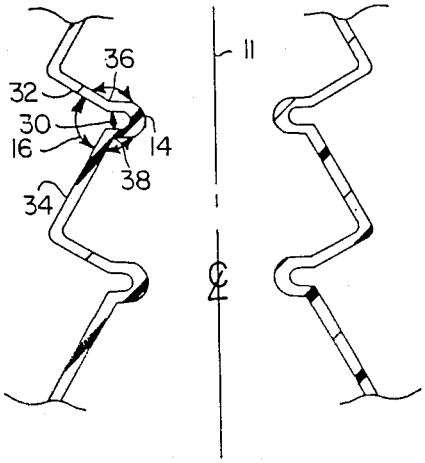
FIGS. 3*a* and 3*b* are schematic partial sections of an alternate form of the modified latching bellows at the inner fold ring.
Figure 3B:
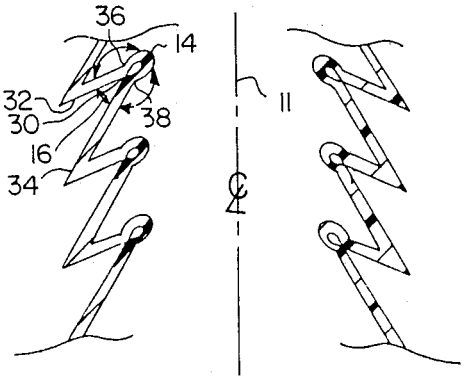

In FIGS. 3*a* and 3*b* the modified inner fold ring angular relationship is taken to the limit by forming the inner fold ring into a "U" section with the angle 30 effectively 0° at the inner fold ring. The angle between the bulk of each sidewall 32 and 34 remains typically about 90°, however, the angular change at angles 36 and 38 is greater in the unfolded and as molded condition. The elastic deformation at angles 36 and 38 upon folding and latching is increased slightly over that in the example of FIG. 2, however, the deformation remains only a small deformation spread over a relatively large area.

The drastic reduction in deformation reduces the weakness caused by crystallization and cracking of the relatively rigid plastic materials and, surprisingly, permits the non-crystallizing very elastic plastics to be effectively utilized for latching bellows in hollow articles. In the latter case of the elastic plastics, the small deformations do not store sufficient elastic energy to self unlatch the bellows from the latched condition. In the former case of the relatively rigid plastics, the deformation is insufficient to impair the strength of the plastic side wall at or near the inner fold rings.

Figure 4A:
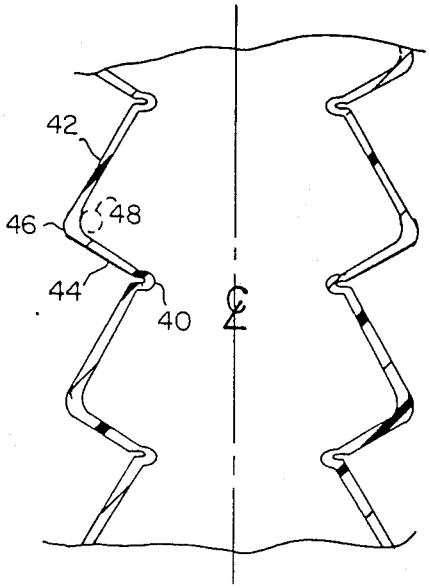
FIGS. 4*a* and 4*b* are partial cross-sections of a hollow article incorporating the modified bellows.
Figure 4B:
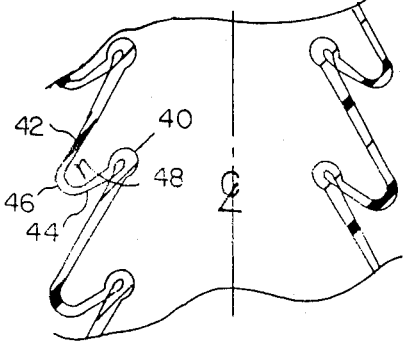

In FIGS. 4*a* and 4*b* a multiple bellow section of a hollow substantially cylindrical article is illustrated. The inner fold rings 40 may be of either configuration illustrated in FIGS. 2 and 3 or of applicant's previous configuration in FIG. 1. The bellows retain the unequal side walls 42 and 44, however, the outer fold rings 46 are modified by providing a definite inner radius 48 rather than a relatively sharp angle. A sharply edged outer fold ring provides a concentrated contact surface more readily subject to damage and puncture from mishandling during manufacturing, storage, filling and transportation. Being at the maximum diameter the wall thickness tends to be least at the outer fold rings. The modification 48 to the outer fold rings 46 decreases the concentrated contact to lessen the likelihood of damage.

The bellows configuration for hollow articles and, in particular bottles and jars, increases the rigidity and strength of the side wall in comparison to a straight wall but with an increase typically of 10 to 40 percent in material. Because of the bellows configuration, the bottles perform better in drop tests than conventional bottles because of a cushioning action created by the bellows similar to a spring bouncing from the ground.

As shown in FIGS. 4*a* and 4*b* the bellows collapse and latch in the same manner despite the modified outer fold rings 46. The configuration of the inner fold rings 40 has been found to be much more critical to the proper latching of the unequal side wall bellows configuration than the configuration of the outer fold rings 46.

Figure 5:
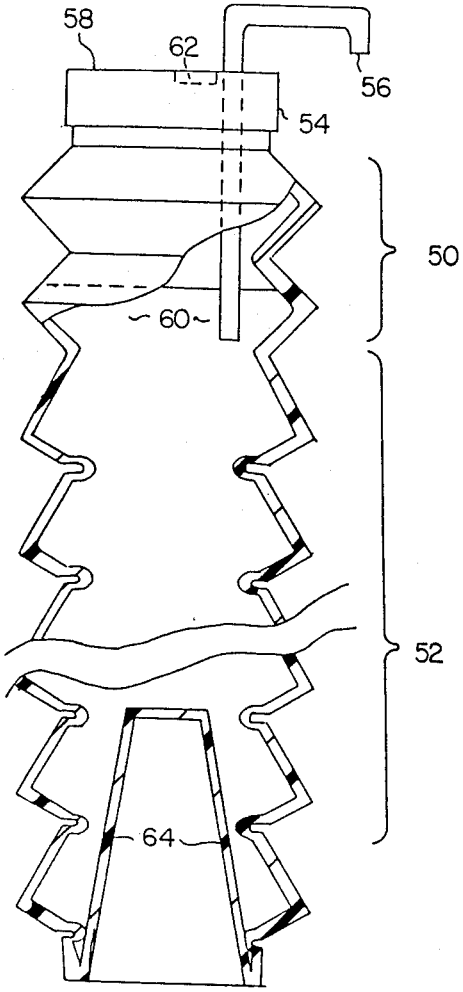
FIG. 5 is a cross-section of a dispensing bottle incorporating the modified bellows.
Figure 6:
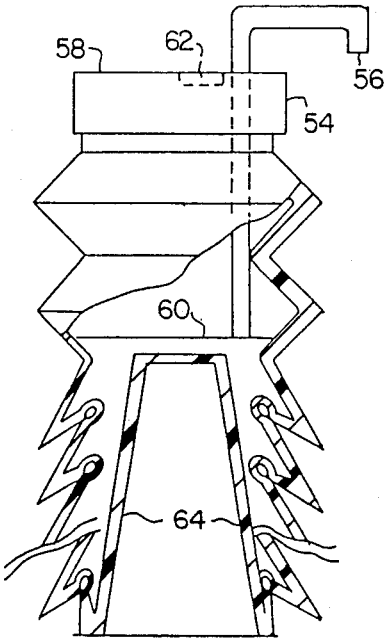
FIG. 6 is a cross-section of the dispensing bottle fully collapsed.

The dispensing bottle pictured in FIGS. 5 and 6 depicts an application of non-latching 50 and latching 52 bellow side walls to a hollow substantially cylindrical article. The top 54 of the dispensing bottle includes a dispensing opening or nozzle 56 and an area 58 upon which the user can press down. The top 54 may be attached to the bottle by any conventional means such as screw threads or detents molded into the top and the engaging portion of the bottle.

In most applications and depending on the nature of the bottle contents the nozzle 56 extends into the contents as shown at 60 and the contents fill the bottle to about the level of the non-latching bellows 50. As shown the non-latching bellows 50 are located above the latching bellows 52, however, the non-latching bellows in some applications may be located below the latching bellows or intermediate upper and lower portions of side wall latching bellows.

By pressing down at 58 the contents are dispensed through the opening 56. Air is admitted into the bottle through a conventional one way valve 62 to permit the non-latching bellows 50 to return to relaxed state after release at 58. With repeated dispensing the latching bellows 52 can be collapsed as the contents are dispensed until fully latched as shown in FIG. 6. To minimize non-dispensed contents the bottle is formed with an elevated base 64 around which the latching bellows collapse as shown in FIG. 6. The elevated base 64 may be formed with a special movable mold section as the dispensing bottle is blow molded or the base may be a separate part sonically welded into an open bottom of the bottle. The elevated base may also be formed as a bistable protrusion from the bottom of the bottle as molded and then snapped up inside the base after molding and cooling of the bottle.

I claim:

1. A collapsible hollow article having a substantially cylindrical side wall about an axis and formed with a plurality of substantially circular bellows, the bellows formed by alternating short and long conical sections with the short conical sections having the bulk of the section sidewalls at a greater angle to the axis of the cylindrical sidewall than the bulk of the section sidewalls of the long conical sections, an the short and long conical sections extending to outer and inner fold rings integral with the conical sections, the improvement comprising an increase in the conical section sidewall angle to the axis for at least one conical section adjacent the inner fold ring of the conical section to provide collapse at the inner fold ring.

2. The collapsible hollow article of claim 1 wherein a plurality of the conical section sidewalls each include an area adjacent the respective inner fold ring at an angle to the axis greater than the angle to the axis of the bulk of the conical section sidewall.

3. The collapsible hollow article of claim 2 wherein both the long and short conical sections include areas adjacent the inner fold rings at angles to the axis greater than the angles to the axis of the bulk of the conical section sidewalls.

4. The collapsible hollow article of claim 1 wherein the angle between the long and short conical sections is at least one inner fold ring immediately adjacent the inner fold ring is approximately 10° in uncollapsed condition.

5. The collapsible hollow article of claim 1 wherein the angle between the long and short conical sections at at least one inner fold ring immediately adjacent the inner fold ring is approximately 0° in uncollapsed condition.

6. The collapsible hollow article of claim 1 wherein at least some of said conical sections flex from the uncollapsed to the collapsed position to provide an overcentering of the bellows during collapse thereby latching the bellows in the collapsed position.

7. The collapsible hollow article of claim 6 wherein a portion of the bellows are non-latching upon collapse.

8. The collapsible hollow article of claim 1 wherein a plurality of the conical section sidewalls each include an area adjacent the respective inner fold ring at an angle to the axis greater than the angle to the axis of the bulk of the conical section sidewall and at least some of said plurality flex from the uncollapsed to the collapsed position to provide an overcentering of the bellows during collapse thereby latching the bellows in the collapsed position.

9. A collapsible hollow article having a sidewall substantially comprising a surface of revolution about an axis, at least a portion of said sidewall formed into a plurality of bellows extending therearound, said bellows comprising upwardly and downwardly pointed substantially conical sections joined by outer and inner fold rings, wherein the angles to the axis of the conical section sidewalls at the inner fold rings are substantially greater than the angles to the axis of the same conical section sidewalls over the bulk of each conical section to provide collapse at the inner fold ring.

10. The collapsible hollow article of claim 9 wherein the bulk angle between adjacent conical section sidewalls is roughly perpendicular and the angle between the same adjacent conical section sidewalls at the inner fold ring approaches 0°.

11. The collapsible hollow article of claim 9 wherein the bulk angle between adjacent conical section sidewalls is roughly perpendicular and the angle between the same adjacent conical section sidewalls at the inner fold ring is approximately 10°.

12. The collapsible hollow article of claim 9 wherein the bulk change of angle between adjacent conical section sidewalls is upon collapse multiple times the change of angle between the same adjacent conical section sidewalls at the inner fold ring upon collapse.

13. The collapsible hollow article of claim 12 wherein one of said adjacent conical section sidewalls flexes from the uncollapsed to the collapsed position to provide an overcentering of the bellows during collapse thereby latching the bellows in the collapsed position.

14. The collapsible hollow article of claim 9 wherein outer fold rings joining adjacent conical section sidewalls are formed with a pronounced inner radius.

15. The collapsible hollow article of claim 9 wherein at least a portion of the plurality of bellows are formed with one of each pair of adjacent conical section sidewalls adapted to flex from the uncollapsed to the collapsed position to provide an overcentering of the bellows sidewall.

16. The collapsible hollow article of claim 15 including at least one non-latching collapsible bellow.

17. A container comprising a top and bottom, a sidewall joining the top to the bottom, said sidewall comprising a plurality of substantially circular bellows, a portion of said circular bellows non-latching upon collapse with the balance of said circular bellows latchable upon collapse wherein the sidewalls of the bellows are substantially conical sections, the adjacent sidewalls of both the latching and non-latching bellows having angles therebetween substantially equal, inner and outer fold rings join adjacent bellow sidewalls, the inner fold rings of the latching bellows having the angle between the pairs of adjacent bellow sidewalls at the inner fold rings substantially less than the angles between the bulk of the bellow sidewalls of the same pairs to provide collapse at the inner fold ring.

18. The container of claim 17 wherein the adjacent sidewalls of non-latching bellows are of substantially the same height and the adjacent sidewalls of the latching bellows are of substantially unequal height whereby the shorter sidewalls of the latching bellows flex to provide overcentering of the bellows during collapse and a positive latch.

19. A collapsible hollow article having a sidewall substantially comprising a surface of revolution about an axis, at least a portion of said sidewall formed into a plurality of bellows extending therearound, said bellows comprising upwardly and downwardly pointed substantially conical sections joined by outer and inner fold rings, the conical sections joining at outer fold rings being of unequal height and the outer fold rings being substantially radiused, the conical sections joining at inner fold rings being of unequal height and the inner fold rings being grooved and retaining substantially fixed diameters whereby the shorter conical sections flex to provide overcentering of the bellows during collapse and a positive latch.

20. A collapsible hollow article having a circumferential sidewall and formed with a plurality of circumferential bellows, the bellows formed by generally conical sidewall sections, said conical sidewall sections extending to outer ad inner fold rings integral with the conical sidewall sections, the improvement comprising an included angle between the sidewall sections adjacent at least one inner fold ring differing from the included angle between the sidewall sections at a substantial distance from the fold ring to provide collapse at the inner fold ring.

21. The collapsible hollow article of claim 20 wherein the included angle between the sidewall sections adjacent the fold ring is less than the included angle between the sidewall sections at a substantial distance from the fold ring.

22. The collapsible hollow article of claim 20 wherein the conical sidewall sections of at least one bellow are substantially equal in height and the conical sidewall sections of at least one other separate bellow are unequal in height.

23. The collapsible hollow article of claim 20 having the sidewall substantially comprising a surface of revolution about an axis, the outer fold rings being substantially radiused relative to the inner fold rings.

24. A collapsible hollow article having a circumferential sidewall, at least a portion of said sidewall formed into a plurality of bellows extending therearound, said bellows comprising generally conical sidewall sections joined by outer and inner fold rings, the outer fold rings being substantially radiused relative to the inner fold rings and the inner fold rings retaining substantially fixed diameters during collapse, said inner fold rings grooved to provide collapse at the inner fold rings.

25. The collapsible hollow article of claim 24 wherein the included angle between the conical sidewall sections adjacent the inner fold rings differ from the included angle between the conical sidewall sections at a substantial distance from the inner fold rings.

26. The collapsible hollow article of claim 24 wherein the included angle between the conical sidewall sections adjacent the inner fold rings is less than the included angle between the conical sidewall sections at a substantial distance from the inner fold rings.

* * * * *

UNITED STATES PATENT AND TRADEMARK OFFICE

CERTIFICATE OF CORRECTION

PATENT NO. : 4,773,458

DATED : September 27, 1988

INVENTOR(S) : William Touzani

It is certified that error appears in the above-identified patent and that said Letters Patent are hereby corrected as shown below:

Column 2, line 33: Insert --latching-- after "modified".

Column 2, line 58: Delete "at" and substitute --in--.

Column 5, line 17: Delete "an" and substitute --and--.

Column 5, line 35: Delete "is" and substitute --at--.

Column 7, line 7: Delete "ad" and substitute --and--.

Column 8, line 16: Delete "differ" and substitute --differs--.

Signed and Sealed this

Fourteenth Day of March, 1989

*Attest:*

DONALD J. QUIGG

*Attesting Officer*

*Commissioner of Patents and Trademarks*